US005239913A

United States Patent [19]

Terauchi

[11] Patent Number: 5,239,913

[45] Date of Patent: Aug. 31, 1993

[54] SLANT PLATE TYPE COMPRESSOR

[75] Inventor: Kiyoshi Terauchi, Isesaki, Japan

[73] Assignee: Sanden Corporation, Gunma, Japan

[21] Appl. No.: 908,997

[22] Filed: Jul. 6, 1992

[30] Foreign Application Priority Data

Jul. 3, 1991 [JP] Japan ..... 3-188263

[51] Int. Cl.[5] ..... F01B 3/00

[52] U.S. Cl. ..... 92/71; 92/12.2; 417/269; 384/620

[58] Field of Search ..... 92/12.2, 71; 417/269; 384/620, 622

[56] References Cited

U.S. PATENT DOCUMENTS 3,469,896 9/1969 Pitner ..... 384/620
3,934,956 1/1976 Pitner ..... 384/620
4,174,191 11/1979 Roberts .
4,175,915 11/1979 Black et al. .
4,850,811 7/1989 Takai .
4,979,877 12/1990 Shimizu ..... 92/71
4,981,419 1/1991 Kayukawa et al. ..... 417/269
5,062,772 11/1991 Shimizu et al. ..... 417/269

FOREIGN PATENT DOCUMENTS 180217 7/1962 Sweden ..... 384/620
0800449 1/1981 U.S.S.R. ..... 384/620

*Primary Examiner*—Thomas E. Denion
*Attorney, Agent, or Firm*—Baker & Botts

[57] ABSTRACT

A slant plate type compressor is disclosed. The drive mechanism of the compressor is provided with a mechanism which substantially eliminates a gap between the wobble plate and the balance weight ring on the slant plate, thereby preventing an offensive noise caused by the collision between the wobble plate and the balance weight ring during operation of the compressor.

11 Claims, 8 Drawing Sheets

SLANT PLATE TYPE COMPRESSOR

TECHNICAL FIELD OF THE INVENTION

The present invention relates to a refrigerant compressor, and more particularly, to a slant plate type compressor suitable for use in an automotive air conditioning system.

BACKGROUND OF THE INVENTION

Recently, slant plate type compressors such as a wobble plate type compressor have become greatly in demand in automotive air conditioning systems. The structure of such compressors is well known in the industry and is shown in FIG. 13. Typically, slant plate 50 is disposed on drive shaft 26 at an angle relative thereto. The rotary motion of drive shaft 26 and slant plate 50 is converted into a wobbling motion having a longitudinal component parallel to drive shaft 26 by wobble plate 60, which is coupled to slant plate 50. The wobbling motion of wobble plate 60 is then translated into a reciprocating motion of pistons 71. Balance ring 90 or annular balance weight is disposed about slant plate 50 to maintain the balance of slant plate 50 as it rotates.

Balance ring 90 is affixed to a boss 54 on slant plate 50. In the typical compressor, wobble plate 60 is disposed between slant plate 50 and balance ring 90. Wobble plate 60 is rotatably mounted on slant plate 50 through bearings 81 and 62. The thrust race 80, is disposed between wobble plate 60 and bearing 81. Because slant plate 50 and balance ring 90 rotate relative to wobble plate 60 and because there is no direct coupling between wobble plate 60 and balance ring 90, collisions often result between wobble plate 60 and balance ring 90. The gap between wobble plate 60 and balance ring 90 is at a maximum when piston 71 is at a top dead center and at a minimum when piston 71 is at a bottom dead center. This is primarily due to the fact that the pressure reaction force of the piston is at a maximum at the top dead center and a minimum at the bottom dead center. As shown in FIG. 13, the minimum gap is indicated as $C_1$ and the maximum gap as $C_2$.

Accordingly, as a result of collisions between wobble plate 60 and balance ring 90, offending noises are generated during compressor operation. This noise is especially remarkable when the compressor is rotating in low speed at high pressure ratio, although the magnitude of the noise level varies with change in the operating condition of the compressor. In addition, the collisions between wobble plate 60 and balance ring 90 cause unnecessary wear and shorten the life span of these parts.

One solution to solve the problem of colliding wobble plate 60 and balance ring 90 is to reduce the gap therebetween. However, it is difficult to manufacture the compressor so that the gap is within the desired tolerance. Furthermore, seizure of the compressor is possible if the gap between wobble plate 60 and balance ring 90 is rigidly reduced. Therefore, it is desirable to provide a compressor with a substantially eliminated or reduced gap between the wobble plate and the balance ring to reduce incidents of collision therebetween while maintaining the operating integrity of the compressor.

SUMMARY OF THE INVENTION

In accordance with the present invention, a slant plate type compressor is provided which substantially reduces or eliminates disadvantages and problems with prior slant plate type compressors.

It is an object of this invention to provide a slant plate type piston compressor having a restraint for preventing collision between the wobble plate and the balance ring. The slant plate type compressor in accordance with one embodiment of this invention includes a spring or bias member which effectively reduces the gap between the wobble plate and the balance ring.

A drive mechanism is coupled to the pistons of the compressor which reciprocates the pistons within the cylinders. The drive mechanism includes a drive shaft rotatably supported in the housing. The drive mechanism further includes a coupling mechanism for coupling the drive shaft to the pistons such that rotary motion of the drive shaft is converted into the reciprocating motion of the pistons. The coupling mechanism includes a slant plate disposed on the drive shaft and having a surface disposed at an inclined angle relative to the drive shaft. The coupling mechanism further includes a wobble plate disposed about a boss of the slant plate. The pistons are linked to the wobble plate by connecting rods. The wobble plate includes a first surface facing the inclined surface of the slant plate and a second surface facing one end surface of an annular balance weight which is fixedly disposed about the boss. Rotary motion of the drive shaft and slant plate causes the wobble plate to nutate and reciprocate the pistons in the cylinders.

In accordance with a first embodiment of the present invention, the compressor further includes a bias member disposed between the inclined surface of the slant plate and the first surface of the wobble plate. The bias member includes a plurality of rolling elements and an annular race of elastic material disposed between the rolling elements and the first surface of the wobble plate. The annular race includes a spring portion disposed between the rolling elements and the first surface of the wobble plate so as to continuously urge the wobble plate toward the annular balance weight.

In accordance with another embodiment of the invention, a bias member is disposed between the wobble plate and the balance ring to eliminate any gap therebetween.

In accordance with yet another embodiment of the invention, a bias member is disposed between a fixed member fixedly disposed about the boss of the slant plate and the balance ring. The bias member effectively urges the balance ring toward the wobble plate.

BRIEF DESCRIPTION OF THE DRAWINGS

For a better understanding of the present invention, reference may be made to the accompanying drawings, in which.

DETAILED DESCRIPTION OF THE INVENTION

Figure 1:
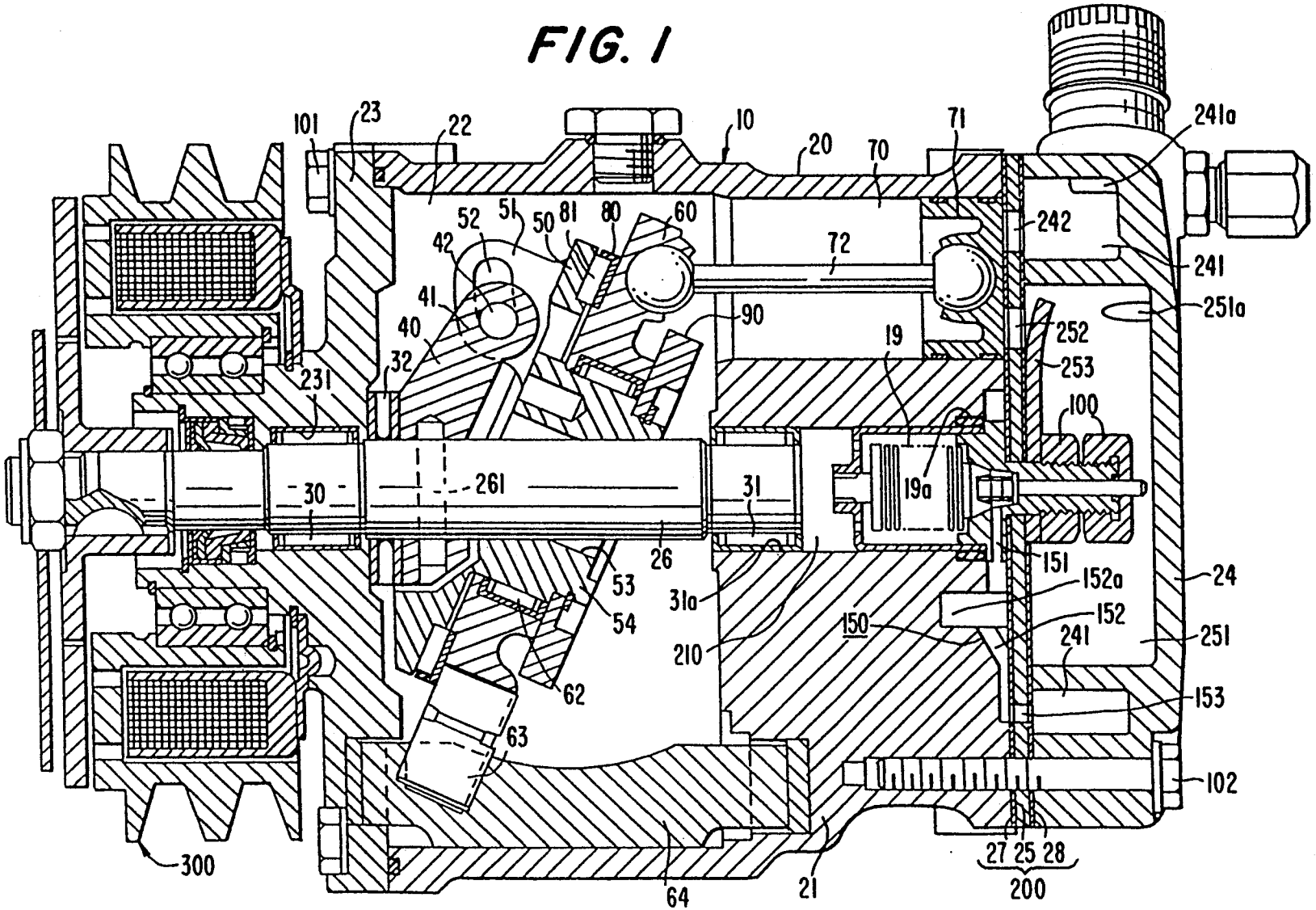
FIG. 1 is a vertical longitudinal sectional view of a wobble plate compressor with a variable displacement mechanism in accordance with a first embodiment of this invention.

With reference to FIG. 1, the construction of a slant plate type compressor, specifically a wobble plate type refrigerant compressor 10, in accordance with a first embodiment of the present invention is shown. Compressor 10 is accommodated within cylindrical housing assembly 20 which includes cylinder block 21, front end plate 23 at one end of cylinder block 21, crank chamber 22 formed between cylinder block 21 and front end plate 23, and rear end plate 24 attached to the other end of cylinder block 21. Front end plate 23 is mounted on cylinder block 21 forward (to the left in FIG. 1) of crank chamber 22 with a plurality of bolts 101. Rear end plate 24 is mounted on cylinder block 21 at its opposite end by a plurality of bolts 102. Valve plate 25 is located between rear end plate 24 and cylinder block 21. Opening 231 is centrally formed in front end plate 23 for accommodating bearing 30 of drive shaft 26. The inner end portion of drive shaft 26 is rotatably supported by bearing 31 disposed within central bore 210 of cylinder block 21. Bore 210 extends to valve control mechanism 19.

Cam rotor 40 is coupled to drive shaft 26 by pin member 261 and rotates with shaft 26. Trust needle bearing 32 is disposed between the inner end surface of front end plate 23 and the adjacent axial end surface of cam rotor 40. Cam rotor 40 includes arm 41 having pin member 42 extending therefrom. Slant plate 50 is adjacent cam rotor 40 and includes opening 53 through which passes drive shaft 26. Slant plate 50 includes arm 51 having a slot 52. Cam rotor 40 and slant plate 50 are connected to pin member 42, which is inserted through slot 52 to effectively create a hinged joint. Pin member 42 is slidable within slot 52 to allow adjustment of the angular position of slant plate 50 with respect to the longitudinal axis of drive shaft 26. Wobble plate 60 is rotatably mounted on slant plate 50 through bearings 81 and 62. Fork-shaped slider 63 is attached to the outer peripheral end of wobble plate 60 and is slidably mounted on sliding rail 64 held between front end plate 23 and cylinder block 21. Fork-shaped slider 63 prevents the rotation of wobble plate 60 so that wobble plate 60 nutates along rail 64 when cam rotor 40 rotates. Cylinder block 21 further includes a plurality of peripherally located cylinder chambers 70 in which pistons 71 reciprocate. Each piston 71 is connected to wobble plate 60 by a corresponding connecting rod 72.

Rear end plate 24 includes peripherally located annular suction chamber 241 and centrally located discharge chamber 251. Valve plate 25 is located between cylinder block 21 and rear end plate 24 and includes a plurality of valved suction ports 242 linking suction chamber 241 with respective cylinders 70. Valve plate 25 also includes a plurality of valved discharge ports 252 linking discharge chamber 251 with respective cylinders 70. Suction ports 242 and discharge ports 252 are provided with suitable reed valves as described in U.S. Pat. No. 4,011,029 issued to Shimizu.

Suction chamber 241 includes inlet portion 241a which is connected to an evaporator of the external cooling circuit (not shown). Discharge chamber 251 is provided with outlet portion 251a connected to a condenser of the cooling circuit (not shown). Gaskets 27 and 28 are located between cylinder block 21 and the inner surface of valve plate 25, and the outer surface of valve plate 25 and rear end plate 24 respectively, to seal the mating surface of cylinder block 21, valve plate 25 and rear and plate 24.

In accordance with a first embodiment of the teachings of the present invention, thrust race 80 is provided for bearing 81 which effectively and variably forces wobble plate 60 to balance ring or annular balance weight 90 mounted about boss 54 of slant plate 50. The structure and function of race 80 may be better perceived in FIGS. 1*a*, 4 and 5.

Figure 1A:
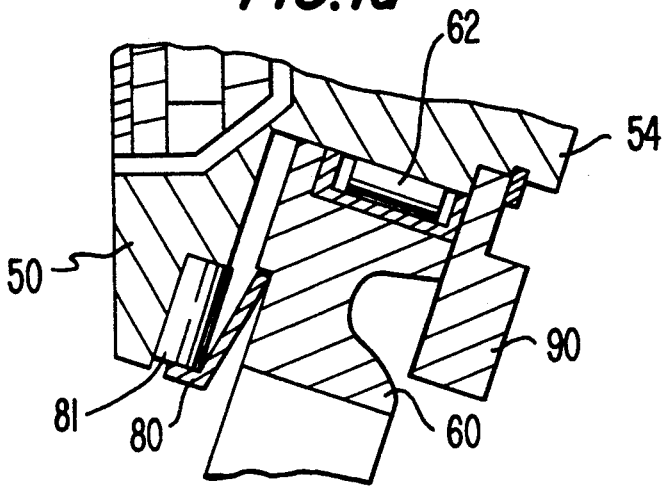
FIG. 1*a* is an enlarged view of a portion of FIG. 1.

Referring to FIG. 1*a*, a greatly enlarged view of thrust race 80 and bearing 81 is shown. Any gap between wobble plate 60 and balance ring 90 is substantially narrowed and eliminated by the present invention because wobble plate 60 is forced toward balance ring 90 by thrust race 80 which adds elasticity between bearing 81 and wobble plate 60. Therefore, collision between wobble plate 60 and balance ring 90 is avoided.

Figure 4:
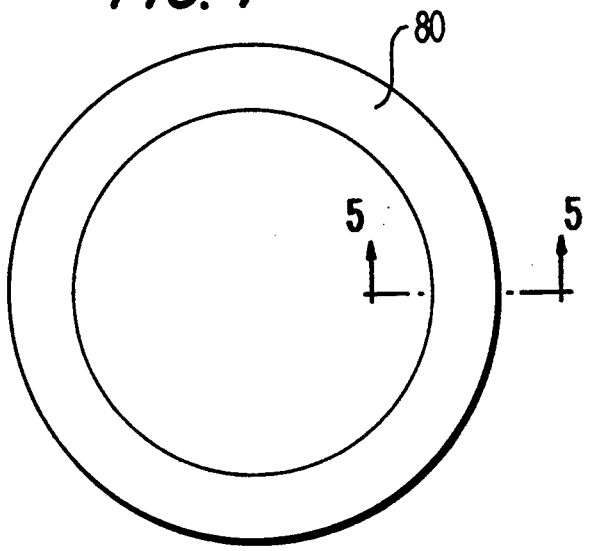
FIG. 4 is a plan view of a thrust race in accordance with the first embodiment of the present invention as shown in FIG. 1.
Figure 5:
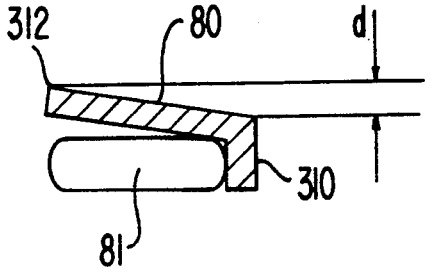
FIG. 5 is an enlarged sectional view of the thrust race taken along line 5—5 in FIG. 4.

As shown in FIGS. 4 and 5, thrust race 80 is constructed by joining a cylindrical race portion 310 with a conical trapezoidal race portion 312 where only a part of conical trapezoidal race portion 312 is in contact with bearing 81. As shown, conical trapezoidal race portion 312 is slightly skewed with respect to a lateral axis shared by wobble plate 60, balance ring 90 or slant plate 50. In addition, race portion 312 may be fabricated of known materials having an elastic property which further increases its elasticity. The distance "d" created by the skewed portion 312 as shown in FIG. 5, is greatly exaggerated. The distance "d" and the spring constant of the skewed portion 312 is designed so as to be able to 10 eliminate the maximum gap Cz when skewed portion 312 receives the maximum pressure reaction force of the piston at the top dead center. However, it is necessary to carefully design the distance "d" and the spring constant of the skewed portion 312 in order to avoid seizure of the compressor caused by an excessive compressional contact between balance ring 90 and wobble plate 60.

Figure 2A:
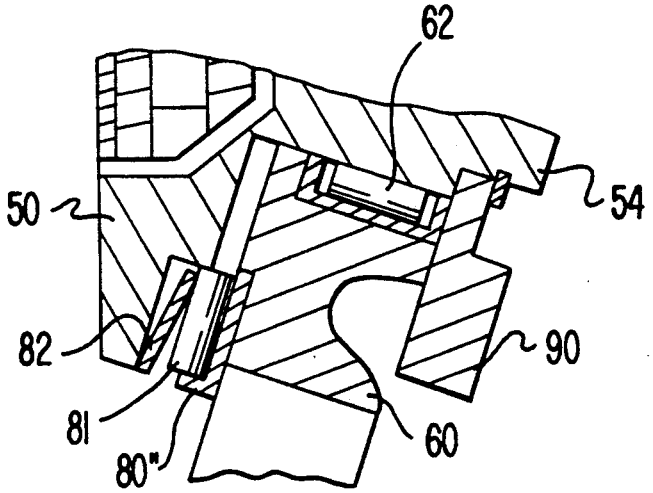
FIG. 2*a* is an enlarged view of a portion of FIG. 2.
Figure 2:
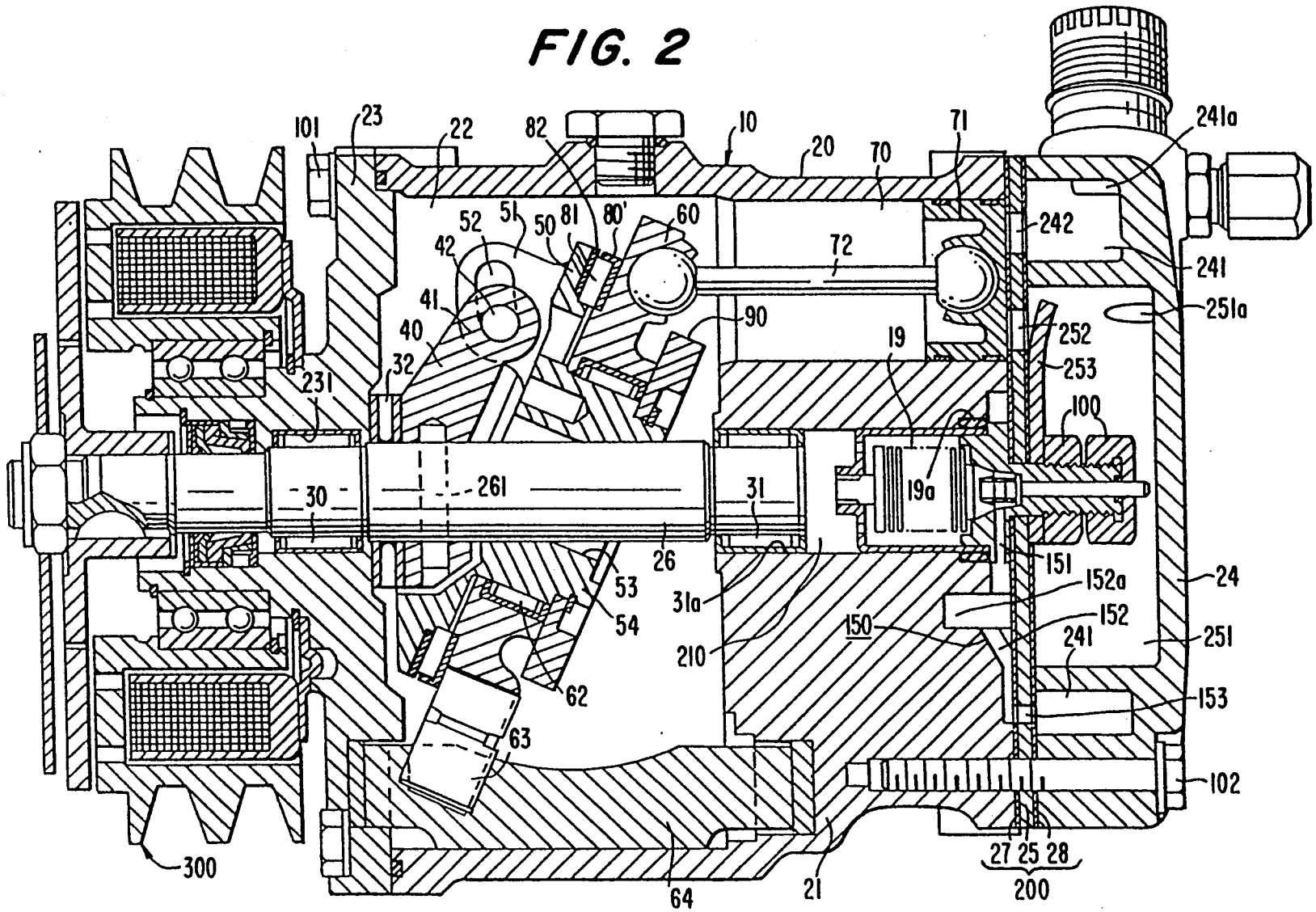
FIG. 2 is a vertical longitudinal sectional view of a wobble plate compressor with a variable displacement mechanism in accordance with a second embodiment of this invention.
Figure 6:
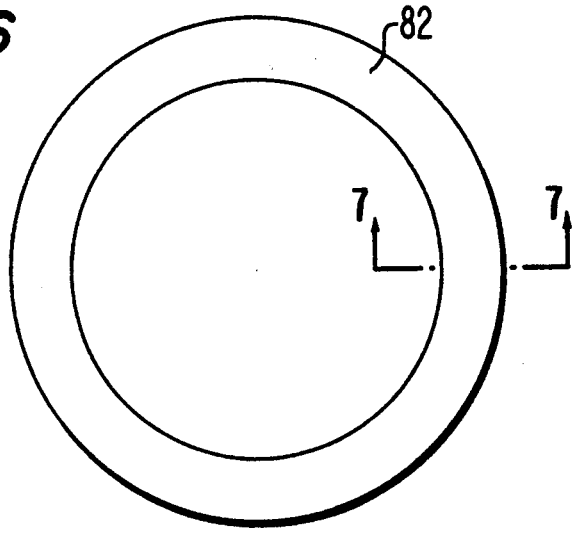
FIG. 6 is a plan view of the thrust race shown in FIG. 2.
Figure 7:
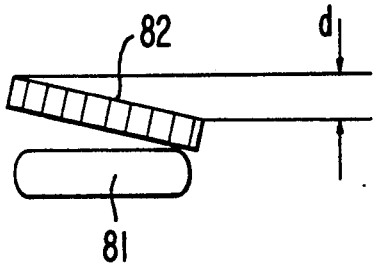
FIG. 7 is an enlarged sectional view taken along line 7—7 in FIG. 6.

FIG. 2 shows a second embodiment of the present invention in which additional race 82 is a hollow conical trapezoid disposed about slant plate 50. FIGS. 2*a*, 6 and 7 show greatly enlarged views of thrust race 82. Thrust race 82, situated slightly skewed away from bearing 81, acts as a bias or spring which effectively and variably urges wobble plate 60 to balance ring 90. Thrust race 82 may also be constructed of materials having elastic properties. The measurement "d" may be determined similarly to that of the first embodiment.

Figure 3:
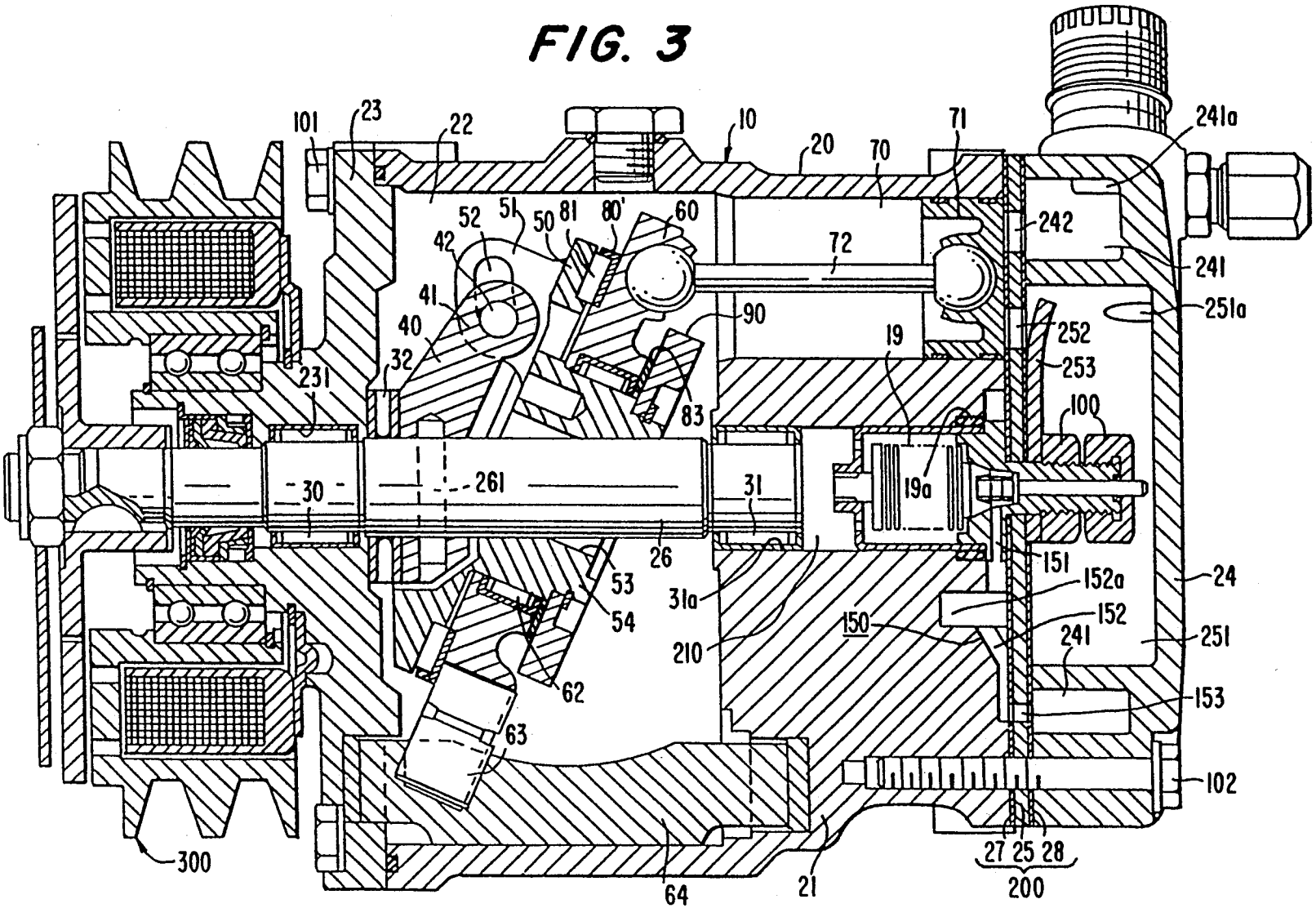
FIG. 3 is a vertical longitudinal sectional view of wobble plate type compressor with a variable displacement mechanism in accordance with a third embodiment of this invention.
Figure 3A:
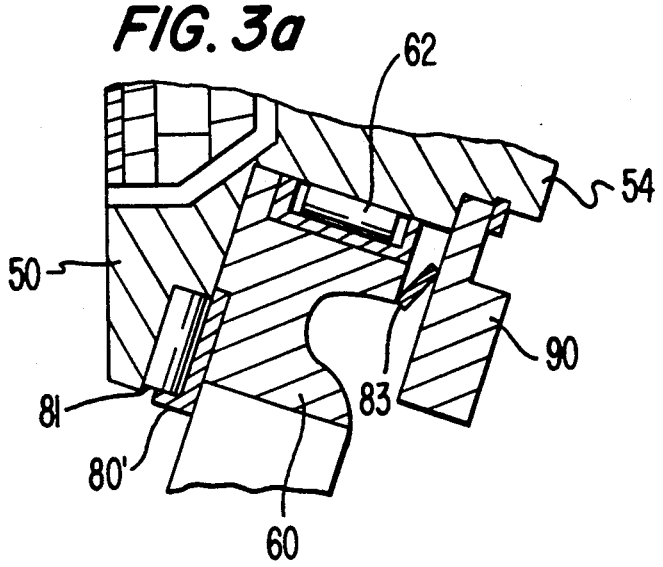
FIG. 3*a* is an enlarged view of a portion of FIG. 3.
Figure 8:
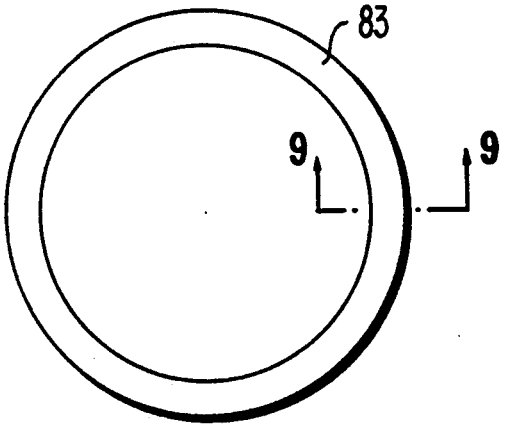
FIG. 8 is a plan view of the thrust race shown in FIG. 3.
Figure 9:
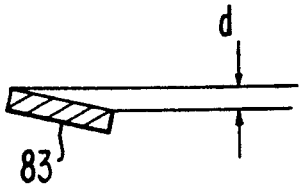
FIG. 9 is an enlarged sectional view taken along line 9—9 in FIG. 8.
Figure 10:
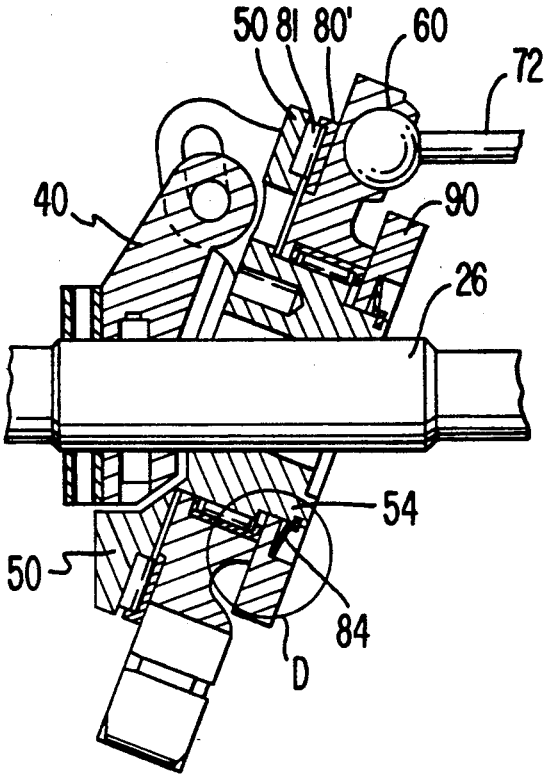
FIG. 10 is a partial cross-sectional view of the drive 10 mechanism of a wobble plate type compressor with a variable displacement mechanism in accordance with the fourth embodiment of this invention.
Figure 10A:
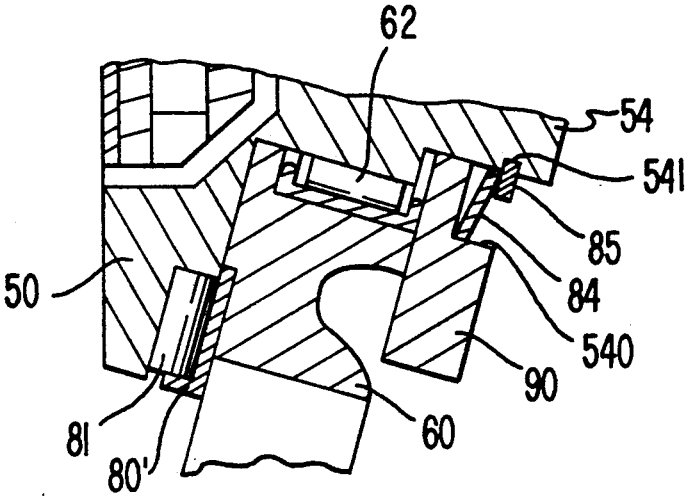
FIG. 10*a* is an enlarged view of a portion of FIG. 10.
Figure 11:
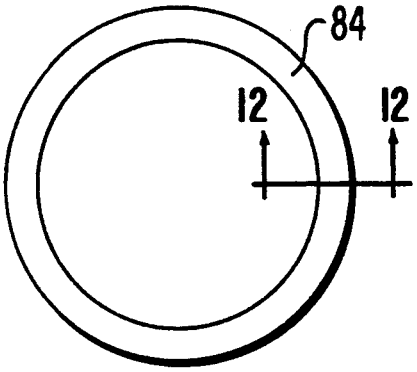
FIG. 11 is a plan view of a thrust race shown in FIG. 10.
Figure 12:
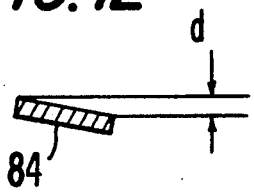
FIG. 12 is an enlarged sectional view taken on line 12—12 in FIG. 11.
Figure 13:
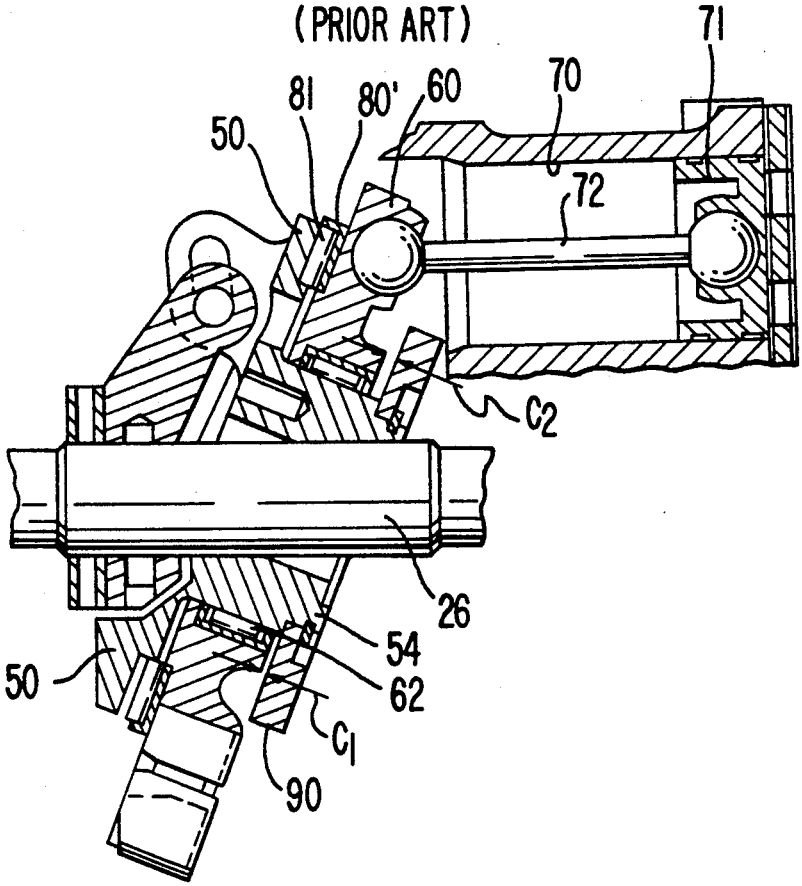
FIG. 13 (PRIOR ART)
FIG. 13 is a partial cross-sectional view of a drive mechanism of wobble plate type compressor with a variable displacement mechanism in accordance with one prior art embodiment.

FIG. 3 shows a third embodiment of the present invention in which additional race 83 is disposed between wobble plate 60 and balance ring 90. In this embodiment, the gap between wobble plate 60 and balance ring 90 is eliminated by adding a bias member therebetween which effectively prevents collision of these parts. Race 83 therefore acts as a spring which causes a controlled separation of wobble plate 60 and balance ring 90. Race 83 may additionally be constructed of elastic materials. FIGS. 3*a*, 8 and 9 show enlarged views thereof and the measurement "d".

FIGS. 10, 10*a*, 11 and 12 further show a fourth embodiment of the present invention in which bias element 84 is arranged between balance ring 90 and fixed elements such as snap ring 85. Bias element 84 and snap ring 85 are preferably annular and are disposed in an annular recess 540 in balance ring 90. Snap ring 85 is fixedly disposed in annular groove 541 formed at an outer peripheral surface of boss 54 of slant plate 50. The skew dimension "d" of annular bias element 84 effectively and variably urges balance ring 90 toward wobble plate 60 to substantially eliminate any gap therebetween. In addition, bias element 84 may be constructed of elastic materials.

The effect of the various embodiments of the invention is to primarily restrain a reciprocal collision between wobble plate 60 and balance ring 90 in a slant plate type compressor. An elastic or bias member is positioned between the wobble plate and bearing, or between the slant plate and the bearing, or between the wobble plate and the balance ring. It is also contemplated that a combination of any or all of the various embodiments may be employed to achieve the same. Furthermore, the wobble plate and balance ring life is advantageously lengthened due to the reduction of reciprocal collision therebetween.

The present invention is not limited to the wobble plate type compressor with the variable displacement mechanism and is applicable to a fixed capacity wobble plate type compressor. Although the present invention has been described in detail, it should be understood that various changes, substitutions and alterations can be made thereto without departing from the spirit and scope of the present invention as defined by the appended claims.

What is claimed is:

1. In a slant plate type compressor including a drive mechanism coupled to and reciprocating a plurality of pistons, said drive mechanism including a drive shaft and coupling means for coupling said drive shaft to said pistons, said coupling means including a slant plate disposed about said drive shaft and being rotatable with said drive shaft, a wobble plate disposed about a boss of said slant plant, an annular balance weight being disposed about and coupled to said boss of said slant plate so that said wobble plate is disposed between said slant plate and said annular balance weight, said rotary motion of said drive shaft and slant plate causing said wobble plate to nutate and thereby reciprocating said pistons, the improvement comprising:

resilient biasing means for substantially eliminating a gap between said wobble plate and said annular balance weight.

2. The compressor of claim 1 wherein said biasing means includes a bearing disposed between said slant plate and said wobble plate, said bearing including a plurality of rolling elements and a generally annular race disposed between said rolling elements and said wobble plate so as to continuously urge said wobble plate toward said annular balance weight.

3. The compressor of claim 2 wherein said annular race includes a spring portion disposed between said rolling elements and said wobble plate.

4. The compressor of claim 3 wherein said spring portion includes a portion being skewed with respect to a lateral axis of said wobble plate.

5. The compressor of claim 1 wherein said biasing means includes an annular member of an elastic material disposed between said wobble plate and said annular balance weight so as to continuously urge said wobble plate toward said slant plate.

6. In a slant plate type compressor including a drive mechanism coupled to and reciprocating a plurality of pistons, said drive mechanism including a drive shaft and coupling means for coupling said drive shaft to said pistons, said coupling means including a slant plate disposed about said drive shaft and being rotatable with said drive shaft, a wobble plate disposed about a boss of aid slant plate, an annular balance weight being disposed about and coupled to said boss of said slant plate so that said wobble plate is disposed between said slant plate and said annular balance weight, said rotary motion of said drive shaft and slant plate causing said wobble plate to nutate and thereby reciprocating said pistons, the improvement comprising:

biasing means for substantially eliminating a gap between said wobble plate and said annular balance weight;

wherein said annular balance weight comprises an annular recess and said boss of said slant plate comprises an annular groove; and wherein said biasing means further comprises:

a first annular member disposed in both said groove and said recessed portion; and a second annular member of an elastic material disposed in said annular recessed portion and between said first annular member and said boss so as to continuously urge said annular balance weight toward said wobble plate.

7. A refrigerant compressor having a slant plate coupled to a wobble plate, said slant plate being further rotatively actuated by a rotating drive shaft, said rotating motion of aid slant plate being translated into a wobbling motion of said wobble plate and thereby causing a reciprocating motion of at least one piston, said slant plate being further coupled to a balance ring, said wobble plate being disposed between said balance ring and said slant plate, the refrigerant compressor further comprising resilient biasing means for biasing said wobble plate toward said balance ring to substantially eliminate any gap between said wobble plate and said balance ring.

8. The compressor, as set forth in claim 7, wherein said biasing means includes thrust bearings disposed between said slant plate and said wobble plate, said thrust bearings having a plurality of rolling elements and an annular race, said race being resiliently and variably biased away from said rolling elements and said slant plate and toward said wobble plate.

9. The compressor, as set forth in claim 7, wherein said biasing means includes thrust bearings disposed between said slant plate and said wobble plate, said thrust bearings having a plurality of rolling elements, an annular race, and a second annular race between said rolling elements and said slant plate, said second annular race being resiliently biased away from said rolling elements and toward said slant plate.

10. The compressor, as set forth in claim 7, wherein said biasing means includes an annular resilient member disposed between said wobble plate and said balance ring.

11. A refrigerant compressor having a slant plate coupled to a wobble plate, said slant being further rotatively actuated by a rotating drive shaft, said rotating motion of said slant plate translated into a wobbling motion of said wobble plate and thereby causing a reciprocating motion of at least one piston, said slant plate being further coupled to a balance ring, aid wobble plate being disposed between said balance ring and said slant plate, the refrigerant compressor further comprising means for biasing said wobble plate toward said balance ring to substantially eliminate any gap between said wobble plate and said balance ring, wherein said balance ring is coupled to a boss of said slant plate, and said biasing means includes an annular member fixedly coupled to said boss of said slant plate and an annular resilient member is disposed between said fixed annular member and said balance ring.

* * * * *